US007992816B2

(12) United States Patent
Wang

(10) Patent No.: US 7,992,816 B2
(45) Date of Patent: Aug. 9, 2011

(54) CRUSHING AND MILLING DEVICE

(76) Inventor: Jian-Wei Wang, Fujian (CN)

( * ) Notice: Subject to any disclaimer, the term of this patent is extended or adjusted under 35 U.S.C. 154(b) by 0 days.

(21) Appl. No.: 12/599,789

(22) PCT Filed: May 14, 2007

(86) PCT No.: PCT/CN2007/001558
§ 371 (c)(1),
(2), (4) Date: Nov. 11, 2009

(87) PCT Pub. No.: WO2008/138171
PCT Pub. Date: Nov. 20, 2008

(65) Prior Publication Data

US 2011/0011964 A1 Jan. 20, 2011

(51) Int. Cl.
*B02C 13/26* (2006.01)

(52) U.S. Cl. ..... 241/188.1

(58) Field of Classification Search ..... 241/187, 241/188.1, 275
See application file for complete search history.

(56) References Cited

U.S. PATENT DOCUMENTS

| | | | | |
|---|---|---|---|---|
| 160,771 | A * | 3/1875 | Hendricks | 241/187 |
| 3,659,793 | A * | 5/1972 | Stephenson et al. | 241/187 |
| 5,009,371 | A * | 4/1991 | Nickel | 241/187 |

* cited by examiner

*Primary Examiner* — Mark Rosenbaum

(57) ABSTRACT

A crushing and mill device includes an outer rotary disk (1) and an inner rotary disk (2) put in said outer rotary disk, wherein, the outer and inner rotary disks communicate the inlet (3) of the feed material, some through holes (20) communicating the outer and inner disk are provided on the sidewall of the inner disk, some carrier plates (4) for carrying the feed material are provided on the places that correspond to the through holes (20) on the disks. The rotations of the outer and inner disks are driven by motors, and the rotations direction of the inner and outer disks are opposite. The sidewall of outer disk has an outlet (10) of the feed material. The feed material enters the inner and outer disks from the inlet, and the feed material is shot off oppositely by the rotations of the outer and inner disk. The feed material passes the through holes of the inner disk and impacts with each other to be broken and milled. The particulates formed by milling are shot off from the outlet on the sidewall of the outer disk. The device can lower energy consumption and raise output.

7 Claims, 3 Drawing Sheets

CRUSHING AND MILLING DEVICE

BACKGROUND OF THE INVENTION

1. Field of the Invention

The present invention relates to a technique for breaking and milling minerals, in particular to a crushing and mill device with high gravity of power capability.

2. Description of the Related Art

As the most ancient and traditional craft, a crushing and milling technique has been lasted for thousands of years. Throughout the industrial revolution, the mineral industrial was especially brought into a great development and growth. Until now, it is ambiguity to clarify the dimension or scale variation of the feeding material in the crushing and the milling stage. Generally, the crushing stage is characterized by an emphasis on a slow increase of the specific surface area, and the milling stage is characterized by an emphasis on a fast increase of the specific surface area. The subject present invention herein focuses on a crushing and mill technique with high gravity acting as an innovated revolution of transformation between the energy and the feed materials, which essentially applies a high gravity power into the relevant device during the operation for concurrently breaking and crushing the material into flour, so as to attain adjustable effects of grinding and milling into granules and particulates.

Various crushing and milling devices are correspondently produced for adapting to different brands of feed materials with components and organizations required to be broken and milled, whereas those feed materials are limited to be crushed approximately at 3 mm or above and thence be milled into granule via the crushing device. Such manipulation substantially decreases the working efficiency and suffers from great abrasion. Accordingly, the general way is to have separate crushing and milling devices for respectively proceeding the breaking and grinding procedures.

In terms of evaluating the efficiency of crushing and milling, a power index measured by kw·h/t is basic on the consuming energy of milling 1t mineral. This index is a critical clue showing whether the crushing and milling system are successful or not. Furthermore, a fineness index is also a key point in the transformation between the energy and feed materials. To express the fineness of the feed materials, indications of mesh number and specific surface area are commonly used. As such, the more mesh number and specific surface area provide, the less fineness of feed material attains.

The large-scale crushing and milling devices are mainly applied to the industries of metallic miner, cement, electricity, chemical, metallurgy, non-metallic miner, etc. However, the problems attendant with the operation of the devices are high consumption of energy, great abrasion, low production, serious contamination to the environment, and poor durability, which renders a high indication of energy consumption in the art and strikes the integral economic effect of the company.

SUMMARY OF THE INVENTION

The object of the present invention is to provide a crushing and mill device with high infusion of gravity, so as to reduce the consumption of energy and preferably increase the production.

The configuration in accordance with the present invention designs a crushing and mill device which includes an outer rotary disk and an inner rotary disk put in the outer rotary disk; wherein, the outer and inner rotary disks communicate with an inlet for feeding material; a plurality of through holes communicating with the outer and the inner disks are provided on a sidewall of the inner disk, and a plurality of carrier plates for carrying the feed material are provided relative to the through holes on the disks. The outer and the inner disks are rotated by motors, and the rotation of the inner disk is directed oppositely to that of the outer disk. An outlet of the feed material is further provided on a sidewall of the outer disk. The feed material enters the inner and outer disks from the inlet, and the feed material is shot off oppositely by the rotations of the outer and the inner disks. The feed material passes the through holes of the inner disk and impacts with each other to be broken and milled into particulates, which are thence shot off from the outlet on the sidewall of the outer disk.

The inner disk defines a central opening connected to the feeding inlet, so that the feed material could sequentially travel from the inlet, through the central opening and the inner disk, then the through holes on the sidewall of the inner disk, and thence to the outer disk.

Preferably, the carrier plate is formed into a bent contour.

Preferably, a detachable moving unit is disposed on a border of the carrier plate.

Preferably, the outer and the inner disks are rotated by the motors, respectively.

Preferably, two rotary shafts disposed on the outer and the inner disks have respective inertial weighty wheels.

Preferably, the inner disk includes two opposite annular plates and a plurality of carrier plates; wherein, the carrier plates are spaced between the two annular plates, and the annular plates including a first and a second annular plates are fixed to two ends of the carrier plates. The rotary shaft of the inner disk passes through a middle orifice of the first annular plate and fastens to an interior of the second annular plate. The feed material goes from an interstice between the middle orifice and the rotary shaft into the inner disk. The outer disk includes two opposite annular plates and a plurality of carrier plates; wherein, the carrier plates are spaced between the two annular plates, and the annular plates including a first and a second annular plates are fixed to two ends of the carrier plates. The rotary shaft of the outer disk is secured to an exterior of the second annular plate. The inner disk penetrates through a middle orifice of the first annular plate of the outer disk for being enveloped in the outer disk.

Accordingly, the present invention takes advantage of the infusion of the high gravity energy serving to hitting the feed materials with each other by a high velocity and broke on impact into granules and particulates. Thus, the present invention has following advantages:

1. In terms of the feed material itself applies the weight thereof to impart a high gravity energy to the other feed material, the feed material injected from the inlet would crash with each other for flashily and simultaneously grinding the material on the impact into the granules and particulates.
2. By the instant completion of the breaking and milling procedures within a small scope, the present invention can feed the material approximately at 3 seconds, attain the quantity of 50-80 T/h per device, and produce the device weighted 1/10 and the bulk measured of 1/6 of the typical ball grinder at the same quantity. Therefore, the present invention conduces to provide the device with a small dimension, achieve a high breaking and grinding efficiency, and increase the producing quantity.
3. Incurring the mutual impact under the high gravity energy, the crushing and mill device greatly decrease the consumption of energy. For example, the slag crushed and grinded would preferably contain particulates over 430 m2/kg specific surface area, electricity consumption per ton is below 15 degrees, which is contradictory to that of the typical ball grinder at the same condition of quantity ranged over 90 degrees and to that of the vertical mill abroad ranged over 40 degrees.

DETAILED DESCRIPTION OF THE PREFERRED EMBODIMENTS

Figure 1:
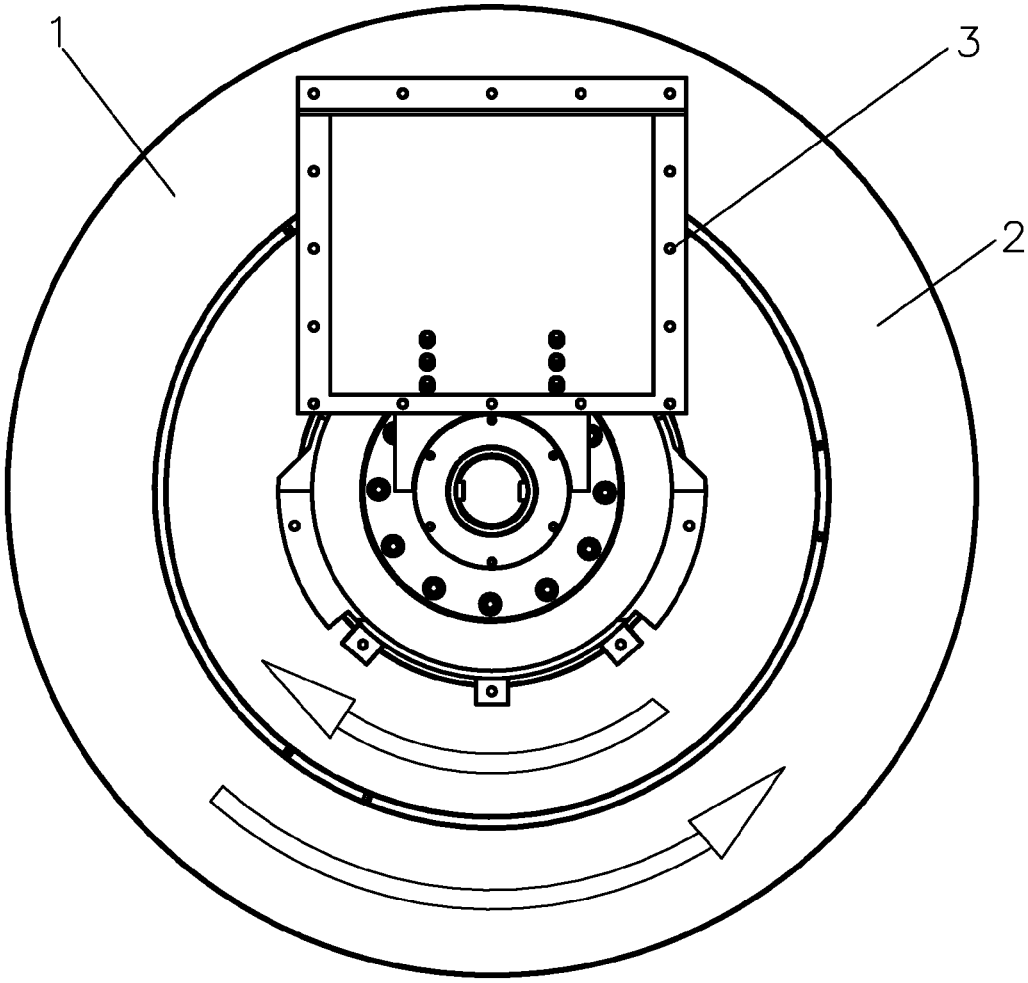
FIG. 1 is a front view showing the present invention.
Figure 2:
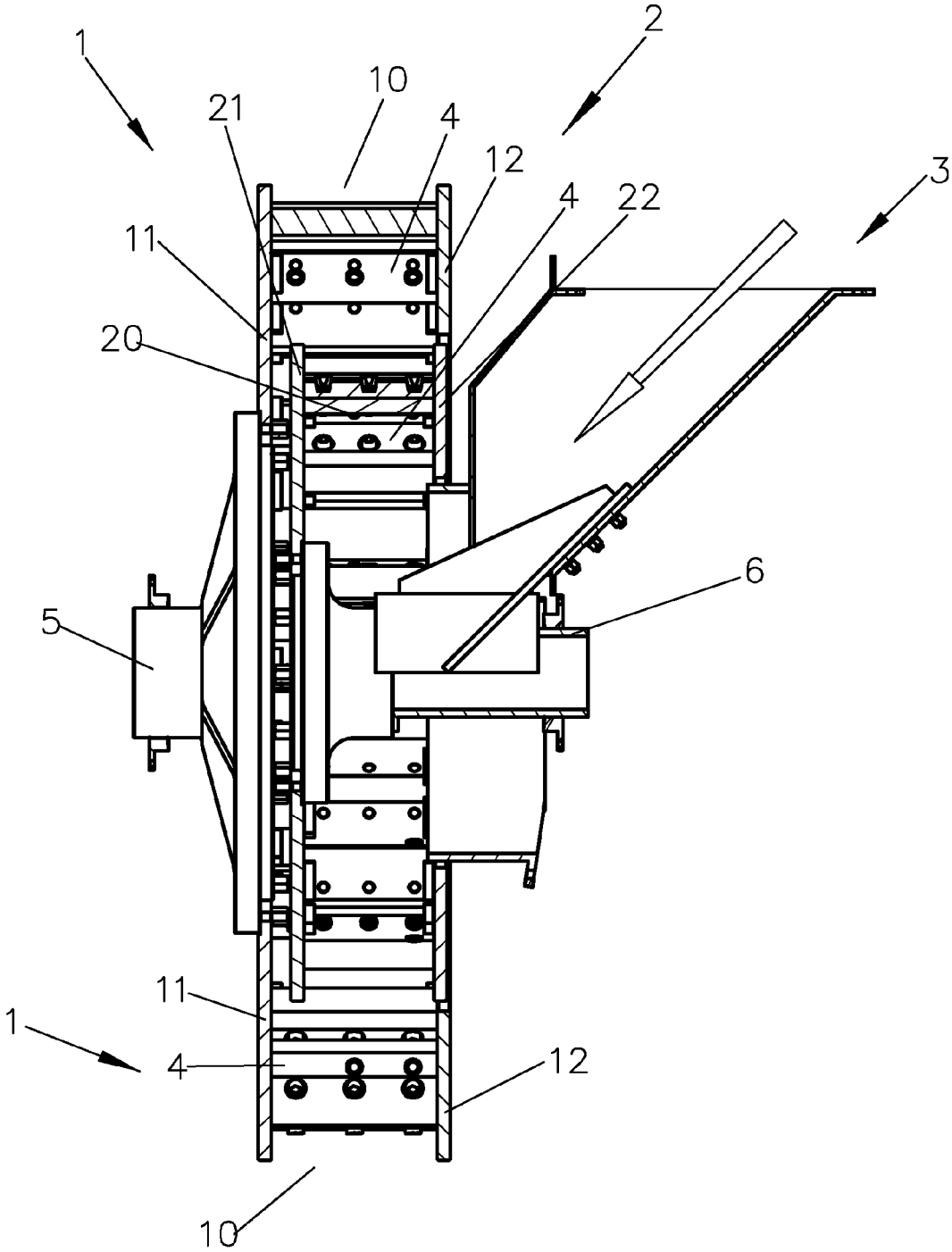
FIG. 2 is a side view showing the present invention in cross section.
Figure 3:
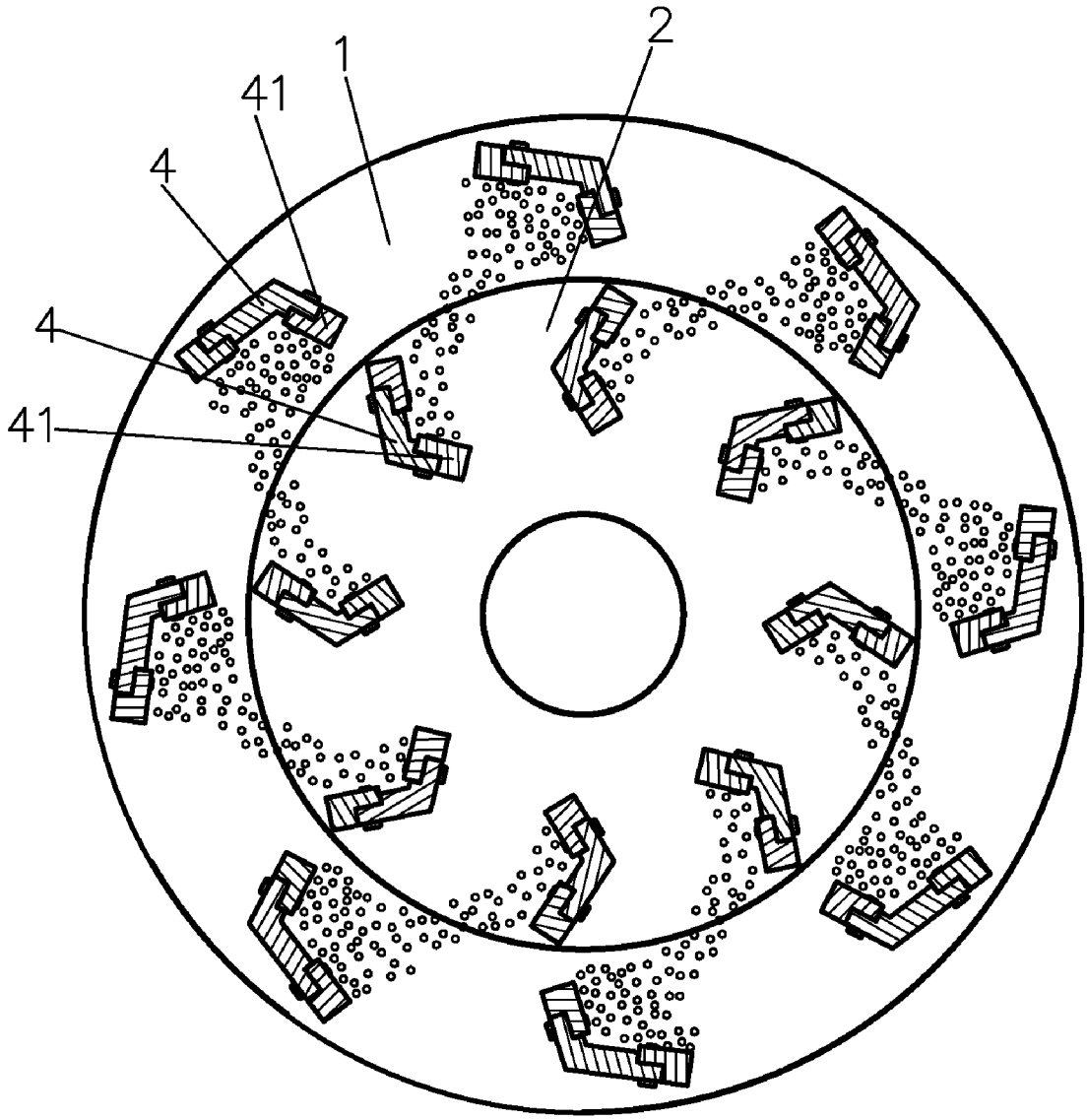
FIG. 3 is a schematic view showing the present invention.

Referring to FIGS. 1 and 2, a crushing and mill device of the present invention includes an outer rotary disk 1 and an inner rotary disk 2 put in the outer rotary disk 1; wherein, the outer and the inner rotary disks 1,2 serve to accommodate and receive feed materials and provide the materials with kinetic power for a rotary emission. Herein, the outer and the inner disk 1, 2 as illustrated in FIGS. 2 and 3. Wherein, the inner disk 2 includes two opposite annular plates 21, 22 and a plurality of carrier plates 4. The carrier plates 4 are spaced between the two annular plates 21, 22, and the annular plates, i.e. a first annular plates 22 and a second annular plates 21, are fixed to two ends of the carrier plates 4. A rotary shaft 6 of the inner disk 2 passes through a middle orifice of the first annular plate 22 and fastens to an interior of the second annular plate 21. Additionally, the outer disk 1 includes two opposite annular plates 11, 12 and a plurality of carrier plates 4; wherein, the carrier plates 4 are spaced between the two annular plates 11, 12, and the annular plates, i.e. a first annular plate 12 and a second annular plates 11, are fixed to two ends of the carrier plates 4. A rotary shaft 5 of the outer disk 1 is secured to an exterior of the second annular plate 11. The inner disk 2 penetrates through a middle orifice of the first annular plate 12 of the outer disk 1 for being enveloped in the outer disk 1.

Further, the outer disk 1 and the inner disks 2 are rotated by the motors (not shown in figures), respectively, and the rotation of the inner disk 2 is orientated oppositely to that of the outer disk 1. For a convenient adjustment to the rotation speed, the outer and the inner disks 1, 2 are rotated by the motors, respectively. For a further reduction of noise, two rotary shafts 5, 6 disposed on the outer and the inner disks 1, 2 have respective inertial weighty wheels (not shown in figures), so as to promote a stable and balanced operation and attain a preferable environment measured below 75 decibels.

The outer disk 1 and the inner disk 2 are communicating with a feeding inlet 3 for feeding materials; wherein, the inner disk 2 defines a central opening connected to the feeding inlet 3, so that the feed material could sequentially travel from the inlet 3 and go into the inner disk 2 through the central opening. As clearly shown in the figures, the feed material enters from the inlet 3 and passes through an interstice between the middle orifice of the first annular plate 22 of the inner disks 2 and the rotary shaft 6. Additionally, a plurality of through holes 20 communicating with the outer and the inner disks 1, 2 are provided on a sidewall of the inner disk 2; alternatively, the through holes 20 could be formed at a space among the carrier plates 4 located between the inner disks 2 for communicating with the outer disk 1 through the side wall of the inner disk 2.

Furthermore, the carrier plates 4 for receiving the feed materials are disposed relative to the through holes and located in the outer disk 1 and the inner disk 2. Referring to FIG. 3, for preferably receiving the feed materials and preventing the device from being subjected to a great abrasion caused by the mutual hitting of the emitted feed materials, the carrier plate 4 is formed into a bent contour. While milling, the emitted feed materials facilely carry the detriment to the border of the carrier plate 4. As such, a detachable moving unit 41 is preferably disposed on the border of the carrier plate 4 for concerning a high cost as a result of the entire replacement of carrier plate 4, whereby merely a partial substitution can satisfy and remedy the carrier plate 4 in a great abrasion. Therefore, the present invention solves the typical problems of a great consumption of the milling medium.

An outlet 10 of the feed material is provided on a sidewall of the outer disk 1. Alternatively, the outlet 10 can be formed at a space among the carrier plates 4 located between the outer disks 1.

In operation, the feed material enters the inner disk 2 and the outer disk 1 from the inlet 3, and the feed material is shot off oppositely by the rotations of the outer and inner disks 2,1. The feed material passes the through holes 20 of the inner disk 2 and impacts with each other to be broken and milled into particulates, which are thence shot off from the outlet 10 on the sidewall of the outer disk 1. Accordingly, the dimension of the outer disk 1 and the inner disk 2, the number of the through holes 20, and the interval therebetween could critically decide the quantity of the milled production and adjust the crushing/breakage degree and fineness. Therefore, the present invention could adjustably regulate the carrier plates 4 and the detachable moving unit 41 base on the softness and hardness of the feed material, so as to prevent the hard material from affecting the consumption of the wearing parts in the device.

I claim:

1. A crushing and mill device comprising:

an outer rotary disk; and an inner rotary disk coupled with said outer rotary disk; wherein, said outer and inner rotary disks communicate with a feeding inlet;

a plurality of through holes provided on a sidewall of said inner disk being communicated with said outer and said inner disks, a plurality of carrier plates for receiving said feed material being disposed relative to said through holes on said outer and said inner disks;

said outer and inner disks being rotated by motors, and a rotation of said inner disk is directed oppositely to a rotation of said outer disk;

an outlet being provided on a sidewall of said outer disk; whereby said feed material entering said inner and said outer disk from said inlet is driven away from said outer and said inner disk, and sent into said through holes of said inner disk, impacting on each other and driven out from said outlet on said sidewall of said outer disk.

2. The crushing and mill device as claimed in claim 1, wherein, said inner disk defines a central opening connected to said feeding inlet for said feed material traveling from said inlet, through said central opening and said inner disk, then, said through holes on said side wall of said inner disk, and thence to said outer disk.

3. The crushing and mill device as claimed in claim 1, wherein, each of said carrier plates is formed into a bent contour.

4. The crushing and mill device as claimed in claim 3, wherein, a detachable moving unit is disposed on a border of each of said carrier plates.

5. The crushing and mill device as claimed in claim 1, wherein, said outer and said inner disks are rotated by said motors, respectively.

6. The crushing and mill device as claimed in claim 1, wherein, two rotary shafts disposed on said outer and said inner disks have respective inertial weighty wheels.

7. The crushing and mill device as claimed in claim 1, wherein, said inner disk includes two opposite annular plates and a plurality of carrier plates; said carrier plates are spaced between said two annular plates, and said annular plates including a first and a second annular plates are fixed to two ends of said carrier plates; said rotary shaft of said inner disk passes through a middle orifice of said first annular plate and fastens to an interior of said second annular plate; said feed material goes from an interstice between said middle orifice and said rotary shaft into said inner disk; said outer disk includes two opposite annular plates and a plurality of carrier plates; said carrier plates are spaced between said two annular plates, and said annular plates including a first and a second annular plates are fixed to two ends of said carrier plates; said rotary shaft of said outer disk is secured to an exterior of said second annular plate; said inner disk penetrates through a middle orifice of said first annular plate of said outer disk for being enveloped in said outer disk.

* * * * *